United States Patent [19]

McQuigge

[11] Patent Number: 4,980,947

[45] Date of Patent: Jan. 1, 1991

[54] CASEMENT WINDOW HINGE

[75] Inventor: Don P. McQuigge, Toronto, Canada

[73] Assignee: Del Mar Hardware Manufacturing Limited, Mississauga, Canada

[21] Appl. No.: 556,427

[22] Filed: Jul. 24, 1990

[51] Int. Cl.[5] ..... E05D 11/08

[52] U.S. Cl. ..... 16/235; 16/361; 16/363; 16/364; 16/371; 16/254; 49/252; 292/263

[58] Field of Search ..... 16/235, 339, 361, 363, 16/364, 366, 370, 371, 254; 49/250–252; 292/263

[56] References Cited

U.S. PATENT DOCUMENTS

| | | | |
|---|---|---|---|
| 1,543,956 | 6/1925 | Soule . | |
| 2,554,862 | 5/1951 | Larson . | |
| 2,654,127 | 10/1953 | Graves . | |
| 2,938,247 | 5/1960 | Hagerty . | |
| 3,579,934 | 5/1971 | Pietsch . | |
| 3,722,142 | 3/1973 | Anderberg | 49/252 |
| 4,226,002 | 10/1980 | Davis . | |
| 4,364,201 | 12/1982 | Taylor | 16/374 |
| 4,571,776 | 2/1986 | Taylor | 16/371 |
| 4,726,092 | 2/1988 | Tacheny . | |

FOREIGN PATENT DOCUMENTS

| | | | |
|---|---|---|---|
| 2125867 | 3/1984 | United Kingdom | 49/252 |
| 2150210 | 6/1985 | United Kingdom | 292/263 |
| 2174141 | 10/1986 | United Kingdom | 292/263 |
| 2204355 | 11/1988 | United Kingdom | 292/263 |
| 2214230 | 8/1989 | United Kingdom | 292/263 |

*Primary Examiner*—Richard K. Seidel
*Assistant Examiner*—Edward A. Brown
*Attorney, Agent, or Firm*—Ridout & Maybee

[57] ABSTRACT

A casement window hinge comprising a toggle hinge assembly slidably received within a laterally symmetrical track. The hinge assembly includes an end block having a sloped upper surface. The ends of the track are notched to assist in alignment of the hinge assembly for insertion into the track.

8 Claims, 3 Drawing Sheets

50
34
36
32
30
40
29
24
28
22
20
26
35
43
3
48
42
45
44
46
38

CASEMENT WINDOW HINGE

FIELD OF THE INVENTION

This invention relates to hinges for casement windows.

In particular, this invention relates to an improved casement window hinge assembly adapted for use with right- or left-hand mounts utilizing a single bidirectional track, and including means for adjusting the window and means for lifting the sash of the window upon closing to counter sash sag.

BACKGROUND OF THE INVENTION

Casement window hinges utilizing the toggle hinge are well known. Typically the casement window sash is hinged to a window frame at its top and bottom utilizing a pair of such hinges, one left-hand configuration and one right-hand configuration. This enables the window to be opened to a position approximately perpendicular to the window frame, displaced from the side of the frame to enable access to both the interior and exterior of the glass.

Most casement window hinges of this type, in which one member of the hinge is slideably received in a channel formed in a track affixed to the window frame, present a number of disadvantages. Separate hinges and tracks must be manufactured in right- and left-hand configurations. There is a tendency for the sash to sag when the window is in the open position, resulting in misalignment of the sash relative to the window frame and making it difficult to close the window. Fine adjustments in the alignment of the mounted window relative to the frame are difficult or impossible. Additionally, the sliding mechanism can be difficult to properly align with the track for insertion.

The present invention overcomes these disadvantages by providing a casement window hinge utilizing a laterally symmetrical track adapted to be mounted on a window frame, and a toggle hinge assembly in which both members of the toggle hinge are slideably received within the track. Thus, a single track can be used to receive either the right- or left-hand toggle hinge assembly, decreasing manufacturing costs and eliminating the need for distributors and users to inventory a separate track for each mount. A notch at each end of the track facilitates alignment of the sliding assembly with the track, for both right- and left-hand configurations.

Furthermore, since the link arm is pivotally attached to an end block slideably received within the track, as opposed to being attached directly to the track as is known, means for countering sash sag is facilitated by providing a sloping upper surface on the end block for this purpose, without the necessity to alter the design of the track itself. Fine adjustments in the alignment of the window can also be easily accomplished by sliding the end block slightly out of the track.

SUMMARY OF THE INVENTION

The present invention thus provides a casement window hinge comprising a track, a sash support arm pivotally connected at an intermediate portion thereof to one end of a link arm, another end of the link arm being pivotally connected to an end block, the end block including an upwardly and rearwardly inclined top face, one end of the sash support arm being pivotally connected to a sliding shoe, whereby the shoe and end block are adapted to be slidably received in a channel formed in the track.

BRIEF DESCRIPTION OF THE DRAWINGS

In drawings which illustrate by way of example only a preferred embodiment of the invention.

DETAILED DESCRIPTION OF THE INVENTION

Figure 7:
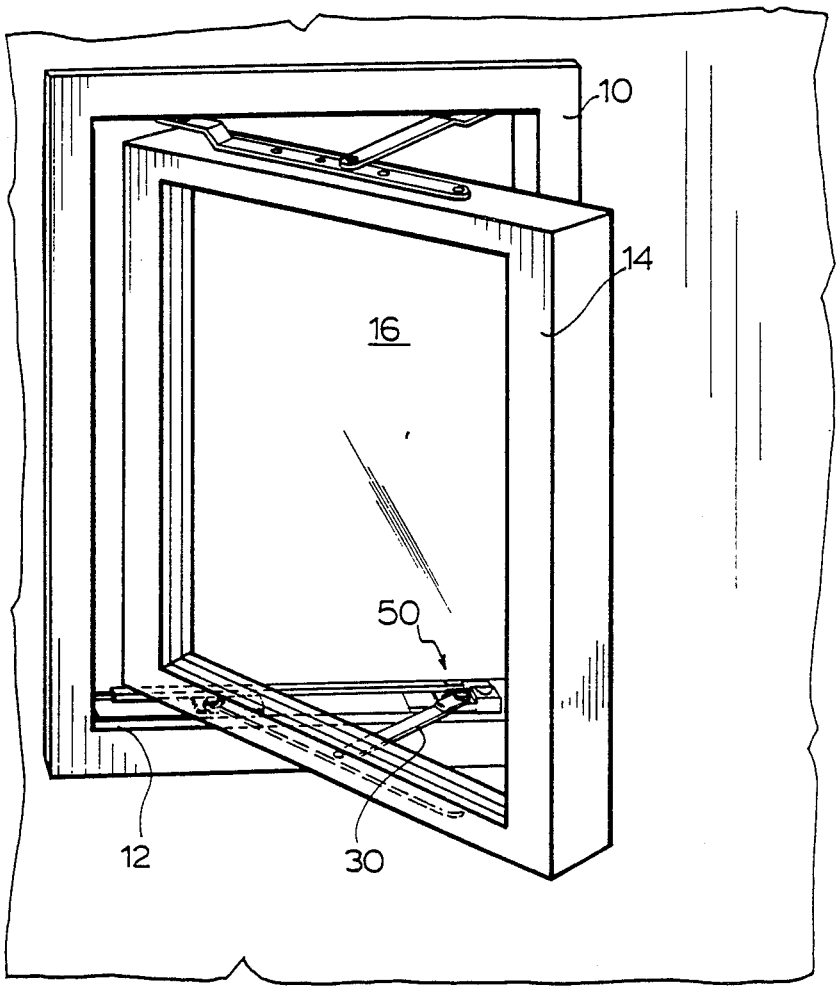
FIG. 7 is a perspective view of the hinge embodying the subject invention as installed.

A typical casement window illustrated in FIG. 7 is provided with a generally rectangular frame 10 having a sill 12, and a window comprising a sash 14 and one or more panes of glass 16. Although intended to provide a perfect clearance fit, rarely is the frame 10 perfectly rectangular, which can be an important cause of sash sag.

Figures 1, 2, 3:
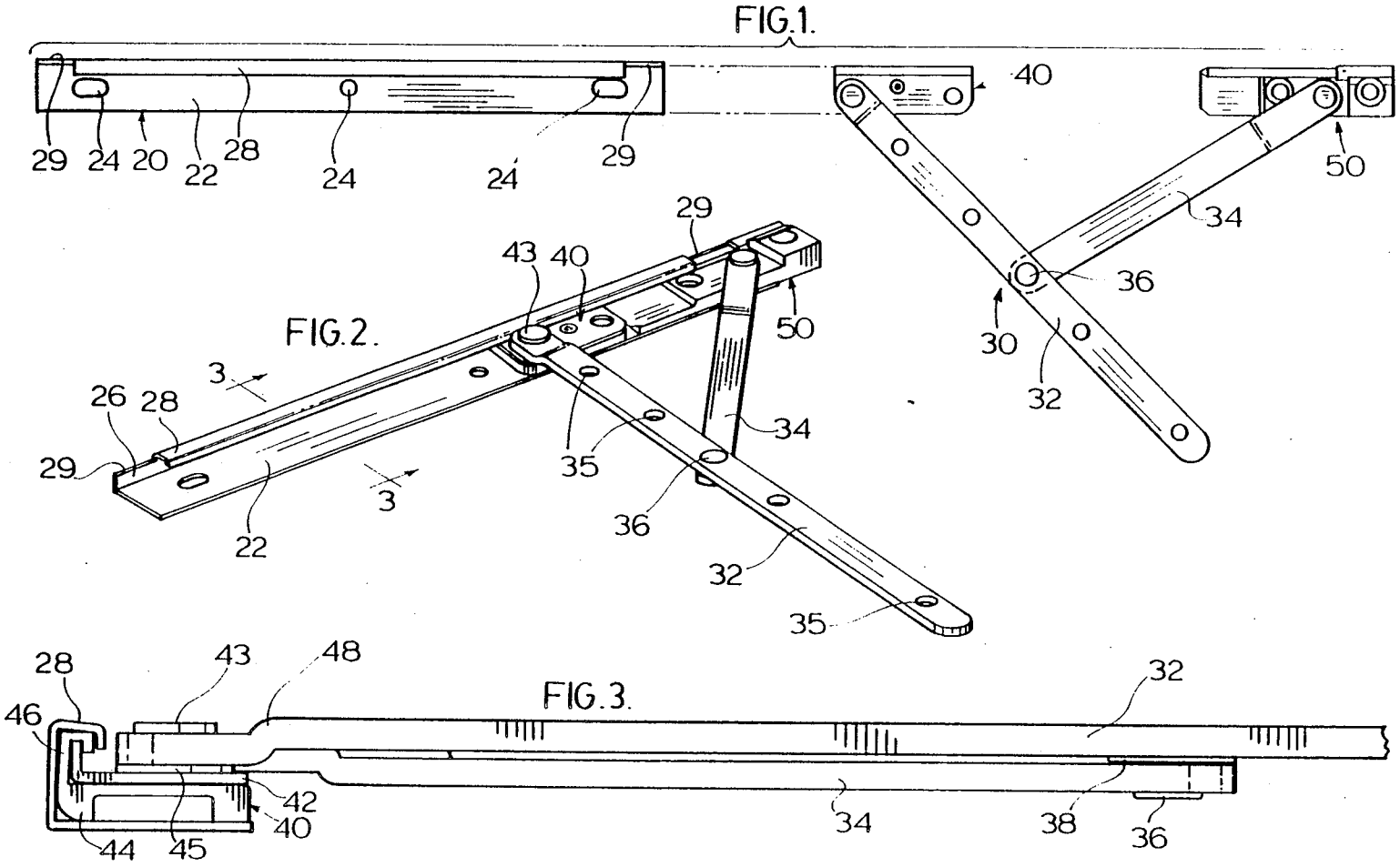
FIG. 1 is a partially exploded top plan view of a casement window hinge embodying the subject invention.
FIG. 2 is a perspective view of the hinge of FIG. 1 in a fully open condition.
FIG. 3 is a cross-section taken at 3—3 of FIG. 2.

Referring to FIG. 1, a track 20 is provided with a base 22 which has suitably located holes 24 through which securing members, such as screws, may be inserted to secure the track to a groove (not shown) in the sill 12. Preferably the hole 24 at each end of the track 20 is a slot, for reasons which will be described below. The track 20 further includes a generally upright back portion 26 terminating in a hooked flange 28 which hooks forwardly and downwardly to provide a channel to slideably secure a toggle hinge assembly 30. A notch 29 is provided such that the hooked flange 28 terminates slightly inset from each end of the track 20 to assist in aligning the shoe 40 and end block 50 with the track 20 during installation, as described in greater detail below.

The toggle hinge assembly 30 comprises a sash support arm 32, having holes 35 through which securing members, such as screws, can be inserted into the vent or sash 14, pivotally connected at an intermediate portion thereof with a link arm 34. The sash support arm 32 preferably overlaps the link arm 34 at the pivot connection 36, which may be a rivet or other pivoting fastening member suitably recessed into the sash support arm 32. Preferably also the sash support arm 32 and link arm 34 are spaced by a plastic washer 38 to reduce friction for smoothness and ease of operation while permitting a tight coupling.

The sash support arm 32 is pivotally connected to a shoe 40, comprising a metallic insert plate 42 riveted or otherwise secured to a moulded plastic sliding member 44. The sliding member 44 is adapted to slideably engage the track 20, and thus includes a raised portion 46 which is slideably received in the channel formed by the hooked flange 28 to prevent dislodgement. The metallic insert plate 42 is preferably coupled to the sliding member 44, and the sash support arm 32 is in turn pivotally connected to the insert plate 42 by a rivet 43, spaced by a plastic washer 45 to reduce friction. The raised portion 46 may hook over a raised portion of the metallic insert plate 42 for additional strength, as illustrated in FIG. 3.

Figure 4:
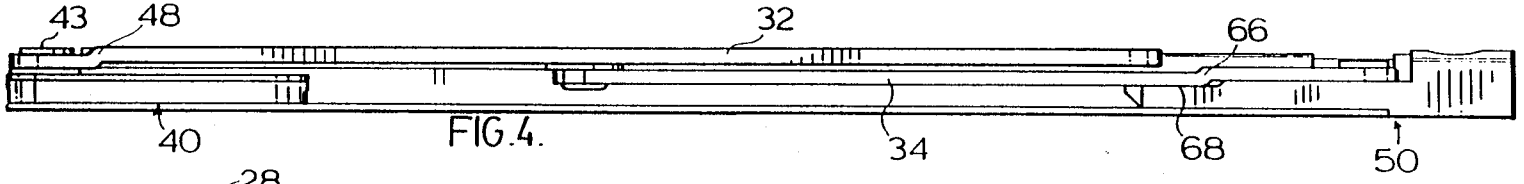
FIG. 4 is a front elevation of the hinge of FIG. 1 in a fully closed condition.
Figure 5:
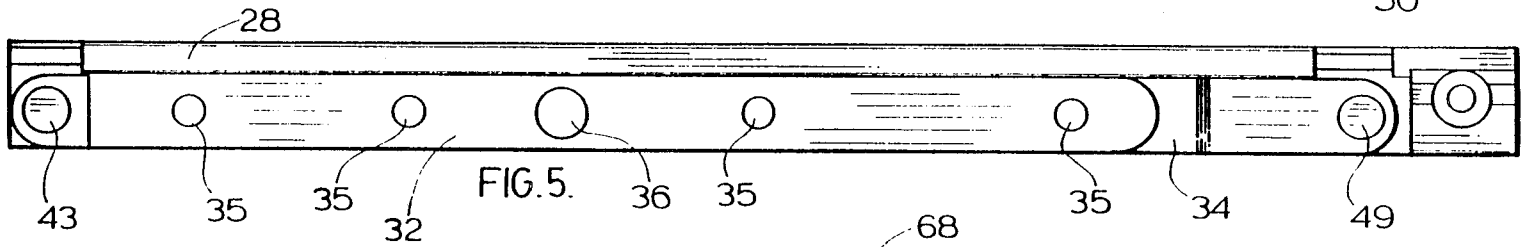
FIG. 5 is a top plan view of the hinge in the fully closed position illustrated in FIG. 4.
Figure 6:
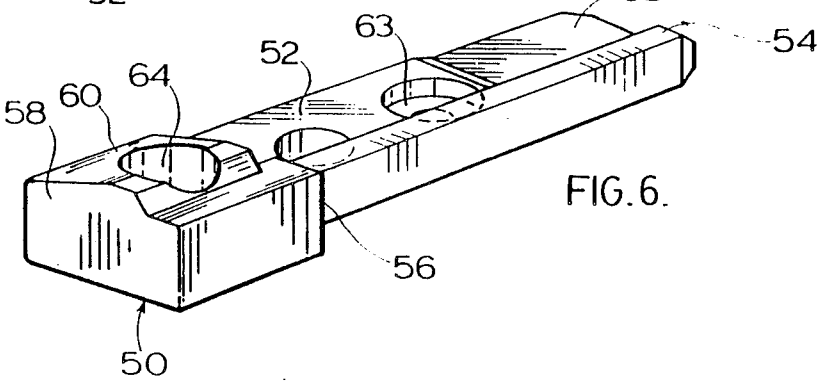
FIG. 6 is a perspective view of the end block in accordance with the present invention.

Preferably the sash support arm 32 rises as at 48 to facilitate overlapping the link arm 34, which may drop slightly in complementary fashion, as can be seen in FIG. 4.

The link arm 34 is pivotally connected to an end block 50 by a rivet 49. The end block 50, preferably molded from plastic, includes an insert member 52, having a raised portion 54 adapted to slideably engage the hooked flange 28 of the track 20, an abutment 56, and a main body 58 which includes a sloped upper edge 60. A countersunk hole 63 through the insert member 52 is adapted to align with an elongated hole or slot 24 in the track, through which a screw or other securing means can be inserted during installation to lock the end block 50 and track 20 to the sill 12 simultaneously. A further countersunk hole 64 through the main body 58 of the end block 50 is provided to receive a securing member for additional strength. A recess 68 may be provided in the insert member 52 to accommodate the drop in the link arm 34 when the hinge is in the closed condition, as illustrated in FIG. 4.

The insert member 52 further acts as a block to stop the sliding shoe 40 as the hinge opens. Preferably the insert member is of a length which will prevent the hinge from opening to an angle greater than 90°, as illustrated in FIG. 2.

To assemble, the track 20 is secured to the appropriate location on the top and bottom of the window frame 10, as illustrated in FIG. 7. However, the hole 24 nearest the end of the track 20 into which the toggle hinge assembly 30 will be mounted is left unused until the window is mounted. It can be seen that the track 20 is laterally symmetrical, and thus able to accommodate either a right- or left-hand configuration of the toggle hinge assembly 30. A left-hand configuration is illustrated in FIGS. 1–6.

The sash support arm 32 is secured to the sash 14 through holes 35, the underside of which may be countersunk for this purpose. It will be seen that if a left-hand toggle hinge assembly 30 is secured to the top of the window sash 14, a right-hand toggle hinge assembly 30 will be secured to the bottom of the sash 14, and vice versa.

To mount the window, the toggle hinge assembly 30 is inserted into the track, first by insertion of the shoe 40 followed by insertion of the insert member 52 of the end block 50. When the end block is fully inserted, as illustrated in FIG. 2, a securing member may be driven through the hole 63 and the aligned elongated hole 24 at that end of the track 20 to secure the end block 50 in place. A further securing member may be driven through the hole 64 for added strength. The mounted window is illustrated in FIG. 7.

Mounting the window with toggle assemblies 30 secured to the sash can be difficult for a single workman, in that the window, which can be fairly heavy, must be supported with one hand while the workman inserts the shoe 40 and then the end block 50 into the appropriate track 20 with the other hand. The notch 29 assists this process by permitting the workman to depress the shoe against the upright back portion 26, thus aligning it with the channel in the track 20, and then slide the shoe 40 laterally into the track 20. A similar procedure can be followed when inserting the insert member 52 of the end block 50.

In operation, the closed window is aligned within the frame 10. As the window is opened, the shoe 40 slides toward the end block 50, meeting the end block 50 when the sash support arm 32 is approximately perpendicular to the window frame 10. As illustrated in FIG. 7, in the open condition the window extends from the frame 10 at an intermediate point thereof, permitting access to both the interior and exterior surfaces of the glass 16, for cleaning and maintenance.

As the window is closed, the shoe 40 slides back toward the opposite end of the track 20, until the sash 14 contacts and slides up the upwardly inclined top surface 60 of the end block 50, thus avoiding interference between the sash 14 and the sill 12 due to sash sag. It will be seen that the hole 64 must be countersunk deeply enough to sink the entire securing member beyond the surface 60 of the end block 50, to avoid interference.

Adjusting the alignment of the window within the frame 10 can be accomplished by, prior to inserting securing members through the end block 50, drawing either the upper or lower end block 50 out of its track 20 until proper alignment has been achieved, and then driving securing members through the holes 63 and 64. For example, in the case of the window illustrated in FIG. 7, the right-hand side of the window can be raised to compensate for misalignment by drawing the end block 50 of the bottom hinge out of its track 20 until proper alignment has been achieved, and driving securing members through the holes 63 and 64. Note that the holes 24 at each end of the track are axially elongated, so that the hole 63 will still align with the hole 24 in the end of the track 20, despite the laterally displaced position of the end block 50.

For replacement or repair, the window may be removed, still attached to each toggle hinge assembly 30, by removing the securing members from holes 63 and 64 and sliding the toggle hinge assembly 30 out of the track 20. As the track 20 remains secured to the sill 12, it is not necessary to realign the hinge when the window is reinstalled.

Having described a preferred embodiment of the subject invention, it will be obvious to those skilled in the art that certain modifications and adaptations may be made without departing from the scope of the invention. All such modifications and adaptations as may fall within the scope of the appended claims are intended to be included in the subject invention.

We claim:

1. A casement window hinge comprising a track, a sash support arm pivotally connected at an intermediate portion thereof to one end of a link arm, another end of the link arm being pivotally connected to an end block, the end block including an upwardly and rearwardly inclined top face, one end of the sash support arm being pivotally connected to a sliding shoe, whereby the shoe and end block are adapted to be slidably received in a channel formed in the track.

2. A casement window hinge as defined in claim 1, wherein the track includes a notch at one end of a hooked flange portion.

3. A casement window hinge as defined in claim 2, wherein the track includes a notch at each end of the hooked flange.

4. A casement window hinge as defined in claims 1, 2 or 3, wherein the end block is composed of plastic.

5. A casement window hinge as defined in claims 1, 2 or 3, wherein the shoe includes a plastic sliding member.

6. A casement window hinge as defined in claim 1, wherein the track includes slots at each end thereof, whereby a window mounted on the hinge can be adjusted by lateral displacement of the end block from a position abutting an end of the track.

7. A casement window hinge as defined in claims 1, 2 or 3, wherein the track is laterally symmetrical.

8. A casement window hinge as defined in claims 1 or 6, wherein the end block includes an insert member which stops the shoe as the hinge opens to prevent the hinge from opening beyond an angle of approximately 90°.

* * * * *